US008776446B1

(12) United States Patent
Jhaveri et al.

(10) Patent No.: US 8,776,446 B1
(45) **Date of Patent: *Jul. 15, 2014**

(54) PHARMACIST WORKSTATION

(75) Inventors: Nimesh S. Jhaveri, Kildeer, IL (US); Archana Dhruve, Bartlett, IL (US); Heather K. Hill, Barrington, IL (US); Dejan Kozic, Wadsworth, IL (US); Laura J. Tebbe, Antioch, IL (US); Susan G. Heald, Buffalo Grove, IL (US); Warit Tulyathorn, Chicago, IL (US); Mark A. Jones, Evanston, IL (US); Sara B. Frisk, Chicago, IL (US); Jennifer M. Levin, Chicago, IL (US); Jennifer A. Comiskey, Chicago, IL (US); David T. Blanchard, Evanston, IL (US)

(73) Assignee: Walgreen Co., Deerfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/286,874

(22) Filed: Nov. 1, 2011

Related U.S. Application Data

(60) Provisional application No. 61/408,950, filed on Nov. 1, 2010.

(51) Int. Cl.
*E04H 3/08* (2006.01)
*E04H 14/00* (2006.01)

(52) U.S. Cl.
USPC ..... 52/36.1; 52/33; 52/79.1; 52/79.8; 52/173.1; 52/234; 186/35; 186/36; 705/2

(58) Field of Classification Search
CPC ..... E04H 3/08; E04H 14/00
USPC ..... 52/36.1, 36.4, 79.1, 79.7, 79.8, 234, 52/238.1, 33, 79.6, 173.1, 174, 236.1; 186/35, 36; 705/2
See application file for complete search history.

(56) References Cited

U.S. PATENT DOCUMENTS 1,348,024 A * 7/1920 McCarty ..... 52/33
1,372,095 A * 3/1921 Shaul ..... 52/65
1,404,613 A * 1/1922 Hormes ..... 434/72

(Continued)

FOREIGN PATENT DOCUMENTS

DE 102004026338 * 12/2005
EP 1748126 A1 * 1/2007

(Continued)

OTHER PUBLICATIONS

Thrifty debuts new prototype. (Thrifty Drug Stores Inc.), Chain Store Age Executive with Shopping Center Age, v69, n2, p. 30(1), Feb. 1993 (2 pages).*

*Primary Examiner* — Basil Katcheves
*Assistant Examiner* — Rodney Mintz
(74) *Attorney, Agent, or Firm* — Francis C. Kowalik; Marshall, Gerstein & Borun LLP; Randall G. Rueth

(57) ABSTRACT

A pharmacist workstation that has a desk that is accessible to customers at a customer position in front of the desk; pharmacist seating directly behind the desk, from which a pharmacist can directly interact with a customer in front of the desk; a pass-through window to a secure preparation area; and a private consulting area that has an entrance that is located to a side of the pharmacist seating.

15 Claims, 14 Drawing Sheets

(56) References Cited

U.S. PATENT DOCUMENTS

RE15,368 E * 5/1922 McCarty ..... 52/33
RE17,178 E * 1/1929 Trapp ..... 52/33
1,717,123 A * 6/1929 Sharp ..... 52/31
1,766,409 A * 6/1930 Stocks ..... 312/42
1,780,102 A * 10/1930 Watt ..... 52/200
1,873,852 A * 8/1932 Rorrer et al. ..... 52/33
2,154,897 A * 4/1939 Grant ..... 52/79.4
2,285,962 A * 6/1942 Foulkes ..... 52/29
2,756,584 A * 7/1956 Shelton ..... 52/236.1
2,823,425 A * 2/1958 Granek ..... 52/65
3,346,997 A * 10/1967 Parrish ..... 52/34
3,437,057 A * 4/1969 Wulff ..... 108/22
3,451,261 A * 6/1969 Olsen ..... 73/116.01
3,470,871 A * 10/1969 Shoen ..... 600/301
3,606,045 A * 9/1971 Abromavage et al. ..... 414/564
3,623,283 A * 11/1971 Abromavage et al. ..... 52/19
3,638,641 A * 2/1972 Abromavage et al. ..... 600/301
3,732,649 A * 5/1973 Mehran ..... 52/169.3
3,742,932 A * 7/1973 Greenspan ..... 600/21
3,789,560 A * 2/1974 Wood ..... 52/236.1
3,862,525 A * 1/1975 Greenspan ..... 52/64
3,879,913 A * 4/1975 Clark ..... 52/741.1
3,897,855 A * 8/1975 Patterson ..... 312/209
3,911,900 A * 10/1975 Shoen et al. ..... 600/301
3,922,788 A * 12/1975 Rota ..... 433/33
4,074,793 A * 2/1978 Yuter ..... 186/38
4,095,379 A * 6/1978 Weintraub ..... 52/29
4,116,509 A * 9/1978 Smith ..... 312/107
4,259,816 A * 4/1981 Bergquist ..... 52/33
4,274,233 A * 6/1981 Currier ..... 52/33
D260,709 S * 9/1981 Perlmutter ..... D6/470
4,288,948 A * 9/1981 Harris ..... 52/28
D262,926 S * 2/1982 Woolford ..... D6/471
4,663,895 A * 5/1987 Brice ..... 52/33
4,821,469 A * 4/1989 Bayless ..... 52/33
4,823,523 A * 4/1989 Coupard et al. ..... 52/3
4,841,692 A * 6/1989 Coupard et al. ..... 52/3
5,039,616 A * 8/1991 Copelan ..... 436/56
5,133,935 A * 7/1992 Copelan ..... 422/430
5,193,648 A * 3/1993 Yuter ..... 186/38
5,355,395 A * 10/1994 Kenneth et al. ..... 376/216
5,511,594 A * 4/1996 Brennan et al. ..... 141/98
5,597,995 A * 1/1997 Williams et al. ..... 235/375
5,622,010 A * 4/1997 Weber ..... 52/36.4
5,775,033 A * 7/1998 Meehan ..... 52/33
5,806,260 A * 9/1998 Quaintance ..... 52/236.3
5,809,708 A * 9/1998 Greer et al. ..... 52/220.7
5,878,535 A * 3/1999 Green ..... 52/33
6,141,924 A * 11/2000 Quaintance ..... 52/236.3
6,196,648 B1 * 3/2001 Henriott ..... 312/196
6,360,494 B1 * 3/2002 Emerson ..... 52/106
6,588,548 B1 * 7/2003 Dewitt ..... 186/2
6,748,704 B2 * 6/2004 Eguchi et al. ..... 52/79.1
6,944,996 B1 * 9/2005 Rowe ..... 52/236.1
7,083,515 B2 * 8/2006 Rapisarda et al. ..... 454/187
7,269,925 B2 * 9/2007 Lam ..... 52/79.1
D553,128 S * 10/2007 Murphy ..... D14/305
7,320,200 B1 * 1/2008 Eisner ..... 52/236.1
7,454,868 B2 * 11/2008 Clark ..... 52/243.1
7,537,030 B2 * 5/2009 Gallant ..... 141/18
7,540,546 B2 * 6/2009 Kern et al. ..... 296/19
7,653,557 B2 * 1/2010 Sweetser ..... 705/3
7,860,724 B2 * 12/2010 Chudy et al. ..... 705/2
7,895,797 B2 * 3/2011 Bridgman et al. ..... 52/174
7,985,382 B1 * 7/2011 Henry et al. ..... 422/291
7,992,355 B2 * 8/2011 Bridgman et al. ..... 52/174
8,087,202 B2 * 1/2012 Ciavolella ..... 52/106
8,097,451 B2 * 1/2012 Gaalswyk ..... 435/289.1
8,402,699 B2 * 3/2013 Henriott ..... 52/36.1
8,474,203 B1 * 7/2013 Stewart et al. ..... 52/236.3
D687,644 S * 8/2013 Jhaveri et al. ..... D6/686
8,533,927 B2 * 9/2013 Atherton et al. ..... 29/464
8,555,578 B2 * 10/2013 Hushek ..... 52/238.1
8,571,886 B2 * 10/2013 Chudy et al. ..... 705/2
8,584,349 B2 * 11/2013 Scannon et al. ..... 29/722
8,590,186 B2 * 11/2013 Puello ..... 40/606.17
8,621,786 B2 * 1/2014 Lam ..... 52/33
8,656,670 B2 * 2/2014 Mouzannar ..... 52/234
8,671,633 B2 * 3/2014 Haab et al. ..... 52/243.1
8,689,493 B2 * 4/2014 Alarcon et al. ..... 52/36.1
8,707,630 B1 * 4/2014 Jhaveri et al. ..... 52/36.1
8,707,633 B2 * 4/2014 Han et al. ..... 52/79.5
2002/0046518 A1 * 4/2002 Eguchi et al. ..... 52/220.1
2002/0108334 A1 * 8/2002 Rapisarda et al. ..... 52/302.1
2003/0131545 A1 * 7/2003 Kishimoto ..... 52/174
2003/0136066 A1 * 7/2003 Kishimoto et al. ..... 52/239
2004/0088187 A1 * 5/2004 Chudy et al. ..... 705/2
2005/0008829 A1 * 1/2005 Suits ..... 428/195.1
2005/0138867 A1 * 6/2005 Zhao ..... 52/79.1
2007/0000185 A1 * 1/2007 DeLine ..... 52/33
2007/0039253 A1 * 2/2007 Snowden ..... 52/79.1
2007/0074471 A1 * 4/2007 Gallagher ..... 52/236.3
2007/0204527 A1 * 9/2007 Clark ..... 52/79.1
2007/0260473 A1 * 11/2007 Cornacchia ..... 705/1
2008/0127574 A1 * 6/2008 Yi ..... 52/8
2008/0173779 A1 * 7/2008 Beno et al. ..... 248/309.1
2008/0313973 A1 * 12/2008 Butler Rolf ..... 52/79.1
2009/0025321 A1 * 1/2009 Cherney et al. ..... 52/238.1
2009/0126285 A1 * 5/2009 Suh et al. ..... 52/79.1
2009/0210359 A1 * 8/2009 Chapman ..... 705/500
2009/0255195 A1 * 10/2009 Bridgman et al. ..... 52/174
2009/0292465 A1 * 11/2009 Kaldewey et al. ..... 701/209
2011/0041434 A1 * 2/2011 Solomon et al. ..... 52/234
2011/0053486 A1 * 3/2011 Holtz et al. ..... 454/187
2011/0173898 A1 * 7/2011 Denicourt et al. ..... 52/79.1
2011/0209415 A1 * 9/2011 Lowes et al. ..... 52/1
2012/0110935 A1 * 5/2012 Pinkas ..... 52/234
2013/0025221 A1 * 1/2013 Mouzannar ..... 52/234
2013/0111825 A1 * 5/2013 Lefkus et al. ..... 52/79.1
2013/0192153 A1 * 8/2013 Kobe et al. ..... 52/234
2013/0219807 A1 * 8/2013 Elliott et al. ..... 52/79.1
2014/0083024 A1 * 3/2014 Koppelman et al. ..... 52/79.5
2014/0090801 A1 * 4/2014 McCahill ..... 165/49
2014/0095190 A1 * 4/2014 Chudy et al. ..... 705/2
2014/0096461 A1 * 4/2014 McLoughlin et al. ..... 52/173.1
2014/0115986 * 5/2014 Lam ..... 52/236.3

FOREIGN PATENT DOCUMENTS

EP 2273400 A1 * 1/2011
WO WO 2006061402 A1 * 6/2006
WO WO 2012134556 A1 * 10/2012

* cited by examiner

Walgreens health explorer

June 20, 2010

Touch a topic you're interested in or explore the whole story.

EVENTS

Lorem ipsum dolor sit amet, consectetuer adipiscing.

Community Walk

Smoking Cessation

Community Health

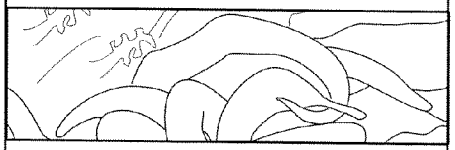

TODAY

June 20, 2010

You Are What You Eat

Community health event features farmers market; nutrition, cooking and gardening tips. Because there's truth to the saying, you are what you eat.

6:00 p.m.
Community Corner

Explore All Services >

SERVICES

Lorem ipsum dolor sit amet, consectetuer adipiscing.

Screenings

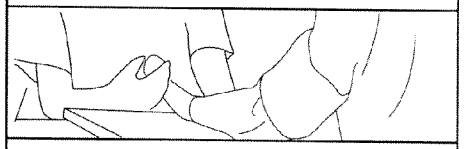

WALK-IN ANYTIME

Cholesterol Screenings

Results are available within five minutes. These tests are used to assess risks of heart disease, metabolic syndrome and diabetes.The participant will be required to fast for at least 2 to 4 hoursbefore the test.

You can or ask health guide for help signing up, then go to the Pharmacist Consult.

Flu Shots

Walgreens Walkers

Explore All Services >

PERKS

Lorem ipsum dolor sit amet, consectetuer adipiscing.

Health Points

Community Card

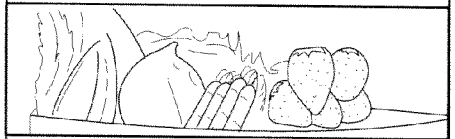

Get Rewarded for Purchasing Healthy Groceries.

You can get health points for purchasing vitamins and healthy groceries. The points can be redeemed for gifts or money off your prescriptions.

Just ask the Health Guide.

Health Goals

Explore All Benefits >

*FIG. 10*

PHARMACIST WORKSTATION

CROSS-REFERENCE TO RELATED APPLICATIONS

The present application claims the benefit of U.S. Provisional Patent Application No. 61/61/408,950 filed Nov. 1, 2010, the disclosure of which is incorporated herein by reference in its entirety for all purposes.

BACKGROUND OF THE INVENTION

The present invention relates generally to pharmacy services, and more particularly to a new retail workspace where pharmacy services are provided. Conventionally, pharmacists work in a secure prescription preparation area, with limited direct exposure to customers.

When it comes to health care, consumers prefer to listen to trusted sources. People often look to friends or neutral parties rather than to medical experts.

Most consumers are self-reliant about health issues. When people encounter a health issue that requires them to make a decision or take action, they like to turn to a variety of resources and make the decision on their own terms, for example by self-diagnosis and searching not only for the answers provided by traditional medicine, but also for alternatives.

Catalysts such as a health crisis or event, an inspiring role model, changes in social milieu, or a trusted source can change attitudes about health care, increasing the belief that action is needed. Reinforcers such as incentives, social support, easy access, and recognition of progress can help drive that action.

It is believed that health care service can be improved by:

relating health care services in to the rhythm of the customer's life;

showing the customer that a range of health services are offered;

offering options for how the customer interacts with the provider; and providing a simplified, light-touch experience.

BRIEF SUMMARY

The applicants have developed a new pharmacy workspace in which a pharmacist has more direct access to customers. In the new workspace, the pharmacist is stationed directly behind a desk that is accessible to customers. A pass-through window over a section of a continuous countertop in the secure preparation area enables the pharmacist to deal with technicians in the secure preparation area. Customer interactions with the pharmacist are further encouraged by providing a private consulting area that has an entrance to a side of the pharmacist seating.

The private consulting area may be arranged perpendicular to the width of the desk. Preferably, the entrance is less than five feet from the pharmacist seating and less than ten feet from the customer position in front of the desk, and the angle between the customer position, the pharmacist seating, and the entrance to the private consulting area is between 45 and 100 degrees.

The entrance to the private consulting area may be between six and eight feet wide, and fitted with a sliding screen that is between two and three-and-a-half feet wide. The sliding screen may have a central section of relatively low transparency and one or more edges of greater transparency. It may slide laterally between (a) a welcoming position in which guest seating in the private consulting area is visible from the customer position in front of the desk and (b) a privacy position in which a section of the screen that has relatively low transparency is interposed between the guest seating and the customer position in front of the desk. In the privacy position, the low-transparency section of the screen screens the guest seating from view from the customer position, but still leaves open a more than 2-foot wide section of the entrance, providing both privacy and openness.

To help ensure security, the pharmacist seating may be positioned between a front counter of the pharmacist desk, a lateral counter that extends rearward from the front counter, and a back wall. Positioning the pass-through window on the back wall, with the pharmacist seating between the front counter and the pass-through window, less than three feet from the pharmacist seating but at least four feet from the front of the desk, makes the pass-through window effectively inaccessible to customers in front of the desk. Similarly, positioning the pass-through window at least three feet from a point on the back wall across from the terminal end of the desk, with the private consulting area being more than six feet from the pass-through window and separated from the pass-through window by the pharmacist seating, makes the pass-through window effectively inaccessible to customers entering or leaving the consulting area.

BRIEF DESCRIPTION OF THE DRAWINGS

The invention may be better understood by referring to the accompanying drawings, in which:

FIG. 10 is an example of a screen display that can be displayed on a touchscreen device in the workspace.

DETAILED DESCRIPTION

Figure 1:
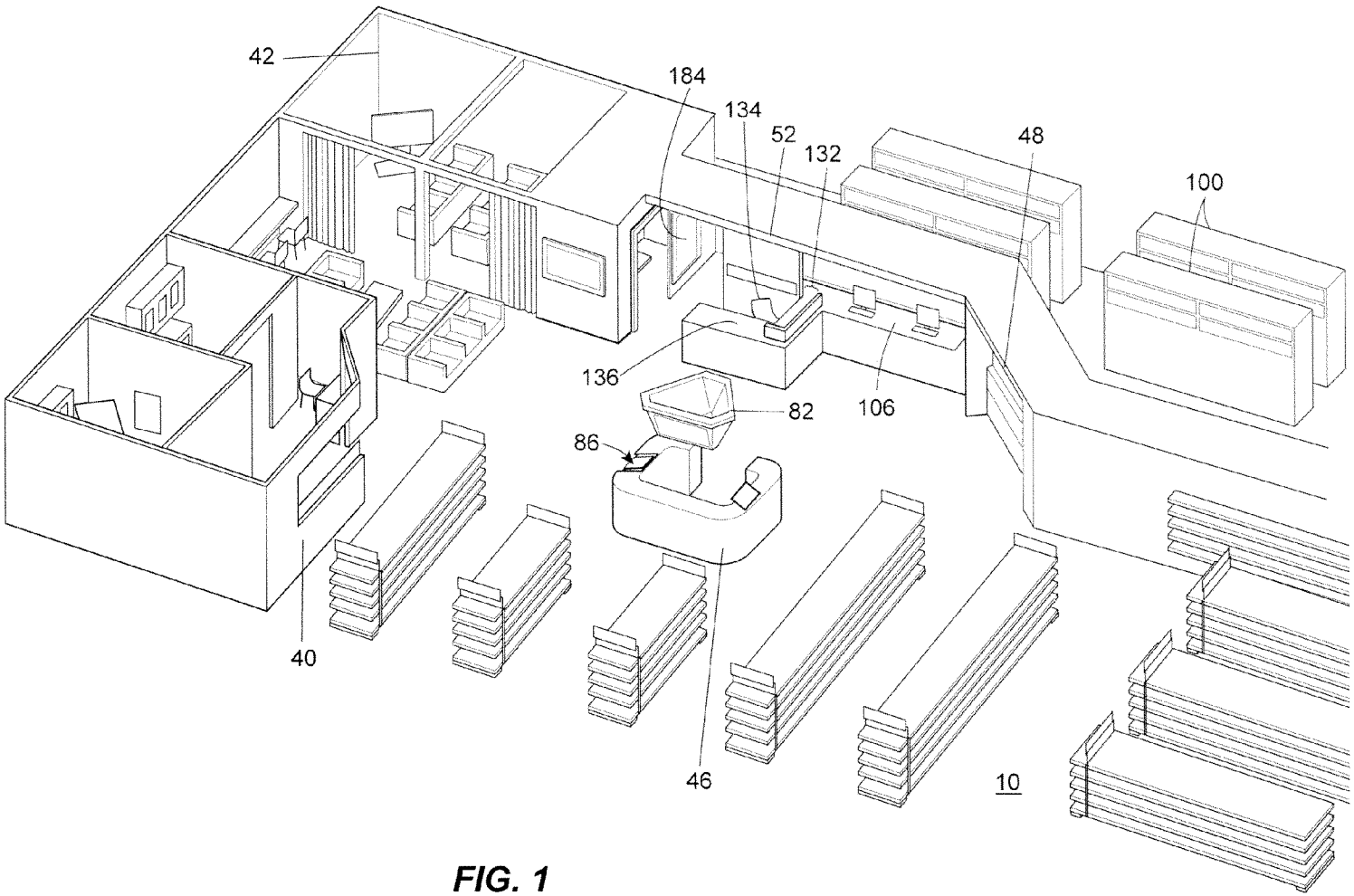
FIG. 1 is a perspective view of one embodiment of the new pharmacy workspace.
Figure 2:
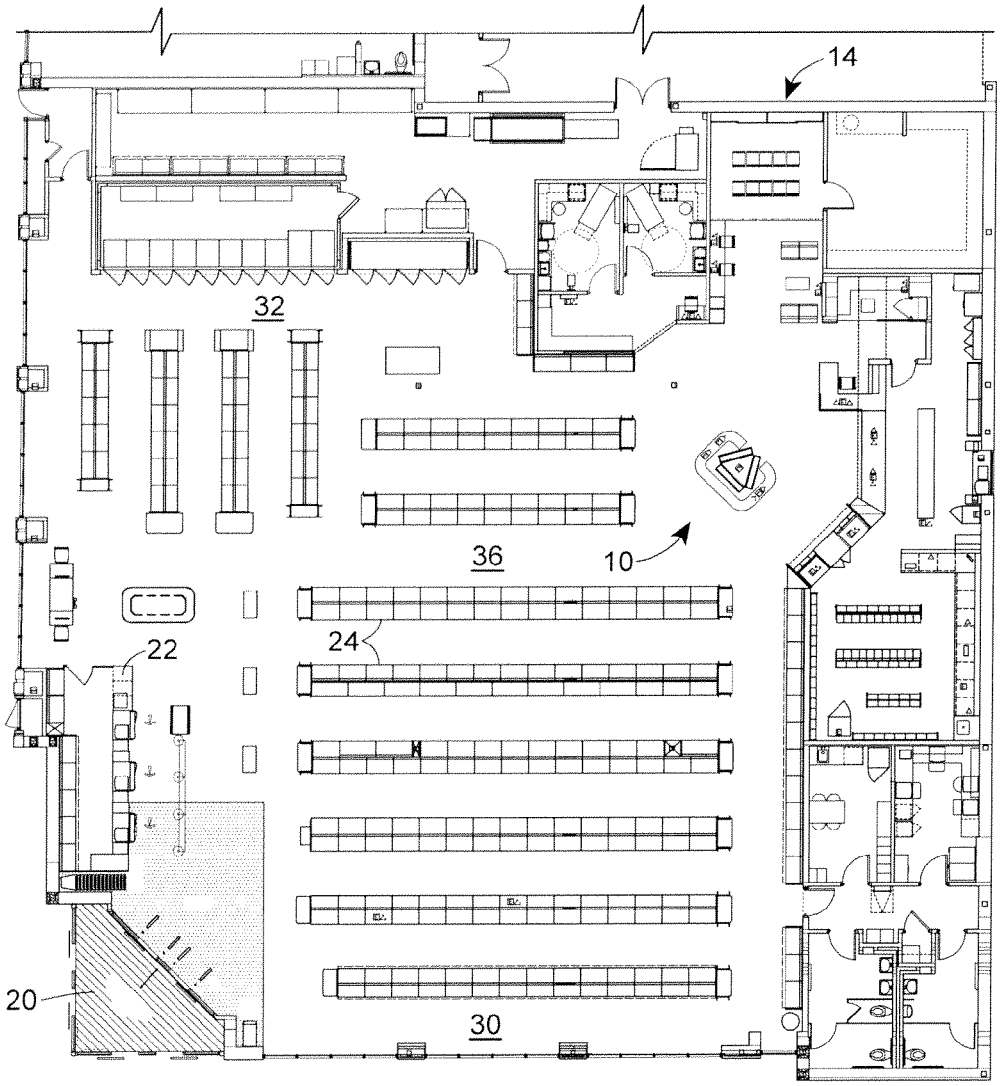
FIGS. 2 and 3 are floor plans of two stores that use embodiments of the new pharmacy workspace.
Figure 3:
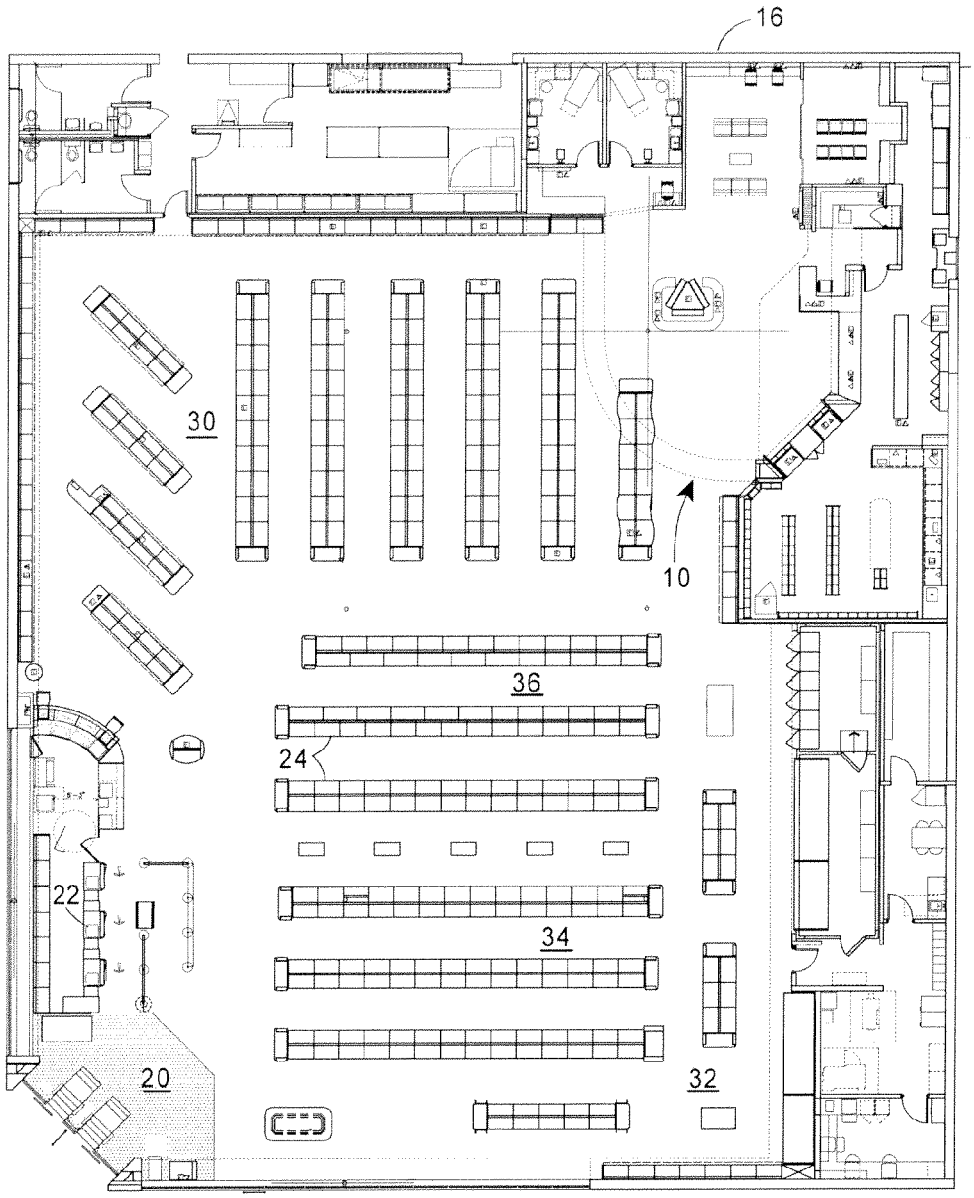

The pharmacy workspace 10 seen in FIG. 1 is one embodiment of a workspace that can be used in a drug store or the like to provide pharmacy services to customers. FIGS. 2 and 3 are floor plans of drug stores 14 and 16 that use embodiments of the workspace. The store 14 seen in FIG. 2 is smaller than the one seen in FIG. 3. Each illustrated store has a front corner vestibule 20 where customers enter and exit the store, a row 22 of check-out counters where customers can pay for their purchases, and shelving 24 for merchandise. As is customary in the trade, similar products can be stocked together, for example with beauty products in a beauty section 30, food items in a food section 32, home products in a home section 34 (FIG. 3), and other products in a general section 36. In these examples, the pharmacy workspace 10 is positioned in a back corner of the store. Positioning the pharmacy workspace away from the vestibule gives customers a chance to see a variety of products as they walk through the store to the pharmacy workspace.

The pharmacy workspaces 10 seen in FIGS. 4-7 each have a clinic station 40, a flexible workspace 42, a primary patient waiting area 44, a reception desk 46, a prescription station 48, a secure preparation area 50, and a pharmacist station 52. Each of the stations is accessible to the public and is separated from the reception desk by an open circulation area 54. Gondolas 56 join the pharmacy workspace with the rest of the store 14 or 16, and are stocked with goods. Touchscreen devices, including a portable "health tablet," are also used in the workspace.

Figure 6:
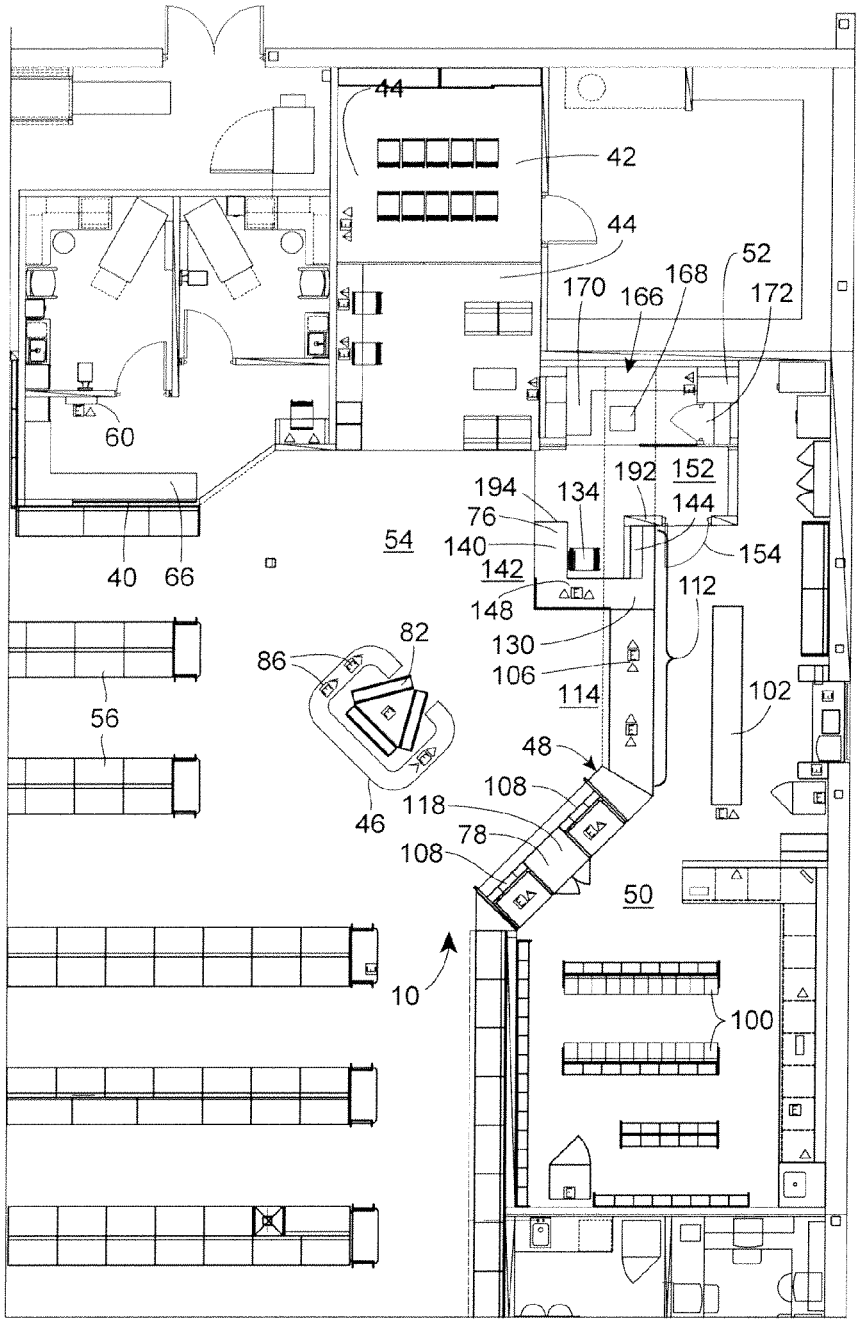
FIGS. 6 and 7 are enlarged fragmentary views of the floor plans seen in FIGS. 2 and 3.
Figure 7:
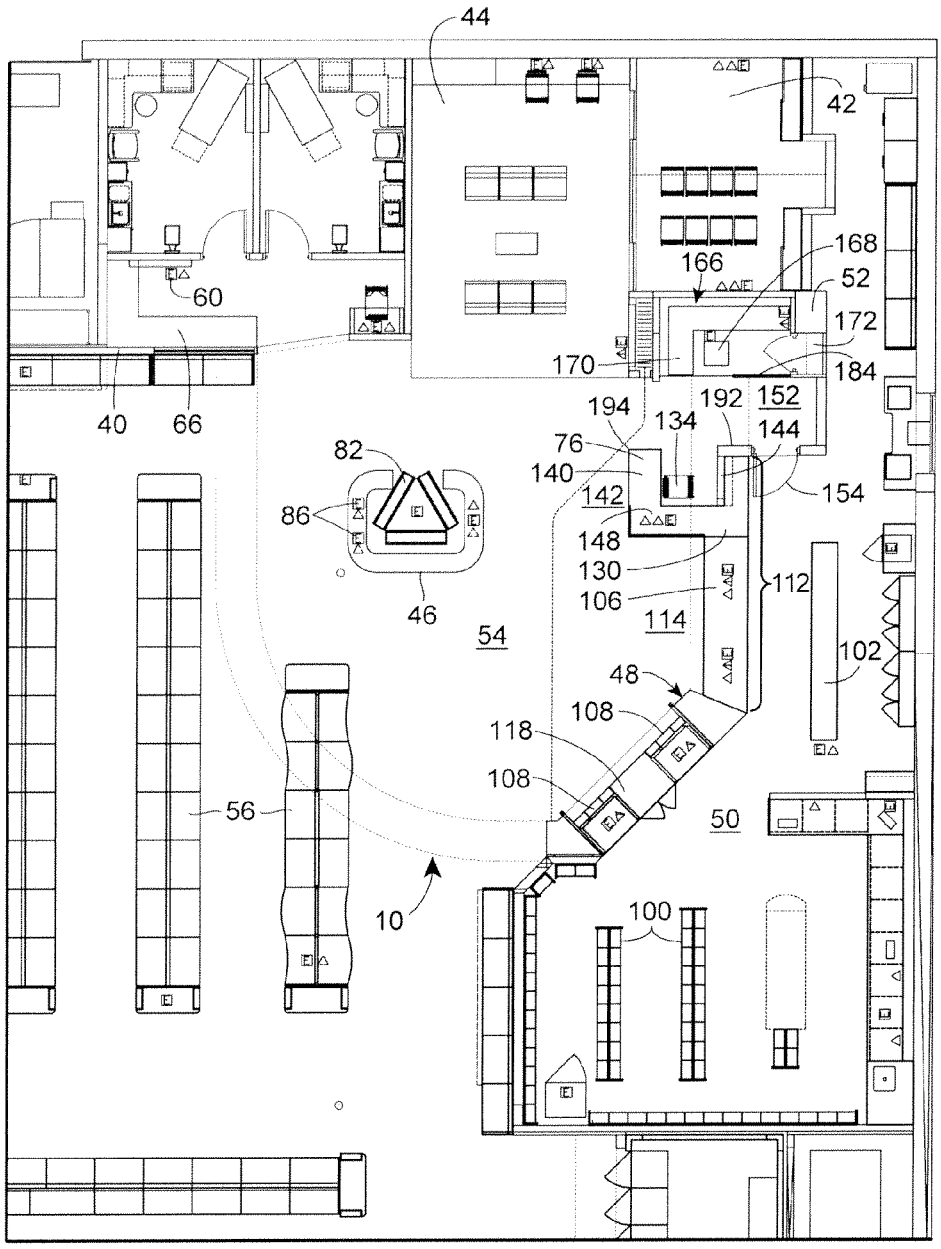

The Clinic Station, the Flexible Workspace, and the Primary Patient Waiting Area Each of the clinic stations 40 seen in FIGS. 6 and 7 provides a walk-in clinic that can be used for common acute health issues such as the flu and ear infections. It also serves as a facility where screenings and physicals can be performed. Services at the clinic station are preferably supervised or performed by a nurse practitioner or similar medical assistant. In the illustrated arrangement, the clinic station 40 also features video-conferencing equipment 60 that enables a customer to communicate with an off-site medical specialist.

The flexible workspace 42 can be used to host individual or group health and wellness events. These events can be sponsored by the store or by guest specialists or institutions. For example, personal trainers, specialist doctors, pharmacists, and nurse practitioners could all use this space to host special sessions related to health and health care. Alternatively, the flexible workspace can be used for one-on-one coaching or as additional space for crowded activities such as administration of flu shots. Providing more space for such activities can increase throughput and also improve the experience for customers.

For flexibility of use, it is preferred that the primary patient waiting area 44 be located adjacent to the flexible workspace 42. A separate waiting area 66 for customers of the clinic station 40 can be located in the clinic station.

The Reception Desk

The reception desk 46 serves as a welcoming position within the pharmacy workspace 10. An employee "health guide" may be stationed there, providing the hub of the customer's experience and offering personal and digital resources that will help customers discover new services, find the answers to product questions, check-in for services, and sign-up for events.

The health guide is preferably a senior technician who is adept at customer interaction, knows the suite of services available at the store, and has a good knowledge of health issues. It is the role of the health guide to welcome customers, to answer health care questions, and to provide information about health care services and options.

It is preferred that the reception desk 46 be separated from the prescription station 48, the pharmacist station 52, and the clinic station 40 by only the open circulation area 54. Such an arrangement helps to reinforce the impression of a curated, organized environment, and provides good visibility of the health options that are available to the customer.

Figure 8:
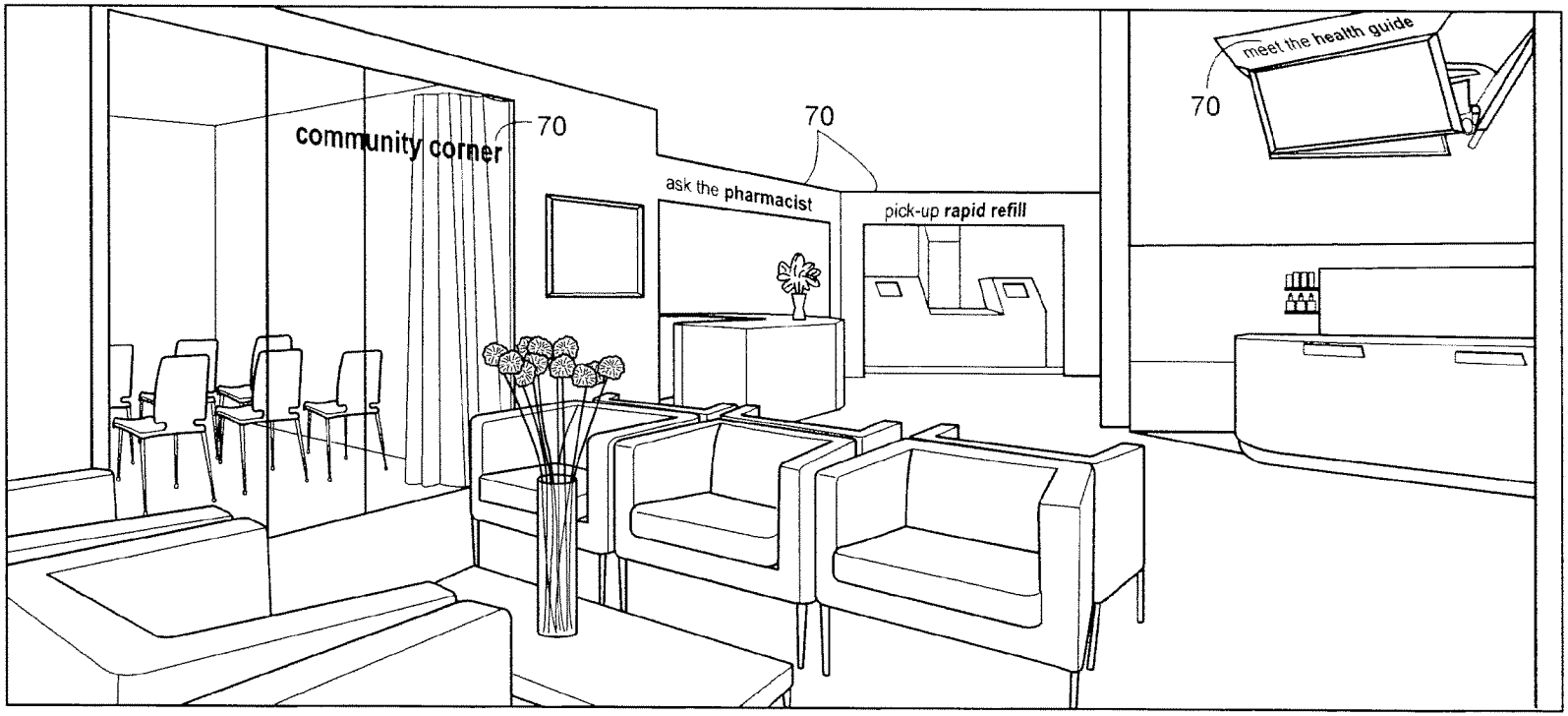
FIGS. 8 and 9 are customer-level perspective views of parts of the new workspace.

As seen in FIG. 8, each station in the illustrated workspace 10 is marked with coordinating signage 70 that states the purpose of that station. Coordinated signage helps consumers recognize the relationship between the various stations and helps to set customer expectations about the services being offered. In addition, large conversational statements may be provided in key areas. For example, the pharmacist station 52 seen in FIG. 9 includes a prominent statement 72 that reinforces a favorable reputation of the pharmacists at the store, helps to build customer trust, and encourages direct contact.

In the arrangement seen in FIG. 6, the reception desk 46 is located approximately twelve feet from a pharmacist desk 76 at the pharmacist station 52 (measured from the center of the reception desk to the center of the pharmacist desk). In this arrangement, the open circulation area 54 is approximately eight feet wide between the reception desk and the nearest part of a prescription desk 78 at the prescription station 48, approximately eight feet wide between the reception desk and the nearest part of the pharmacist desk 76, and approximately twelve feet wide between the reception desk and the entrance to the clinic station 40. In the arrangement seen in FIG. 7, the reception desk 46 is located approximately fourteen feet from the pharmacist desk (measured the same way as above). In this arrangement, the open circulation area is approximately twelve feet wide between the reception desk and the nearest prescription desk, approximately eight feet wide between the reception desk and the nearest part of the pharmacist desk, and approximately eight feet wide between the reception desk and the entrance to the clinic station.

Overhead displays 82 provide continuously updated information about where the customer falls in the queue for services. In the illustrated arrangement, these displays take the form of three large flat screen displays arranged in a triangular configuration over the reception desk 46.

Touchscreen Devices

As seen in FIGS. 1, 6 and 7, two fixed kiosks 86 are mounted at the illustrated reception desk 46. These kiosks include touchscreen devices that customers can use to check in for services to be provided at the clinic station 40 or for community health care events to be conducted at the flexible workspace 42. A separate portable touchscreen device, called a health tablet, can also be provided and used by the health guide.

The store's computer system may be programmed to use the kiosks 86 or health tablets to provide customers with health care information and thus enhance consultations with customers by providing personal profiles, medication guidance, suggested healthy goal-setting, and in-depth information about community events, news, and pharmacy programs. The information may be categorized in categories such as news, events, products, services, and perks. In the example seen in FIG. 10, one of the touchscreen devices presents topics under the categories of events, services, and "perks." Under a "perks" program, customers are given points for purchasing vitamins and healthy groceries. The points can be redeemed for gifts or money off prescriptions. The computer system may also be programmed to use the touchscreen devices to provide the customer with third party health recommendations. These recommendations can include, for example, government or health officials' general recommendations about diet or exercise.

Figure 11:
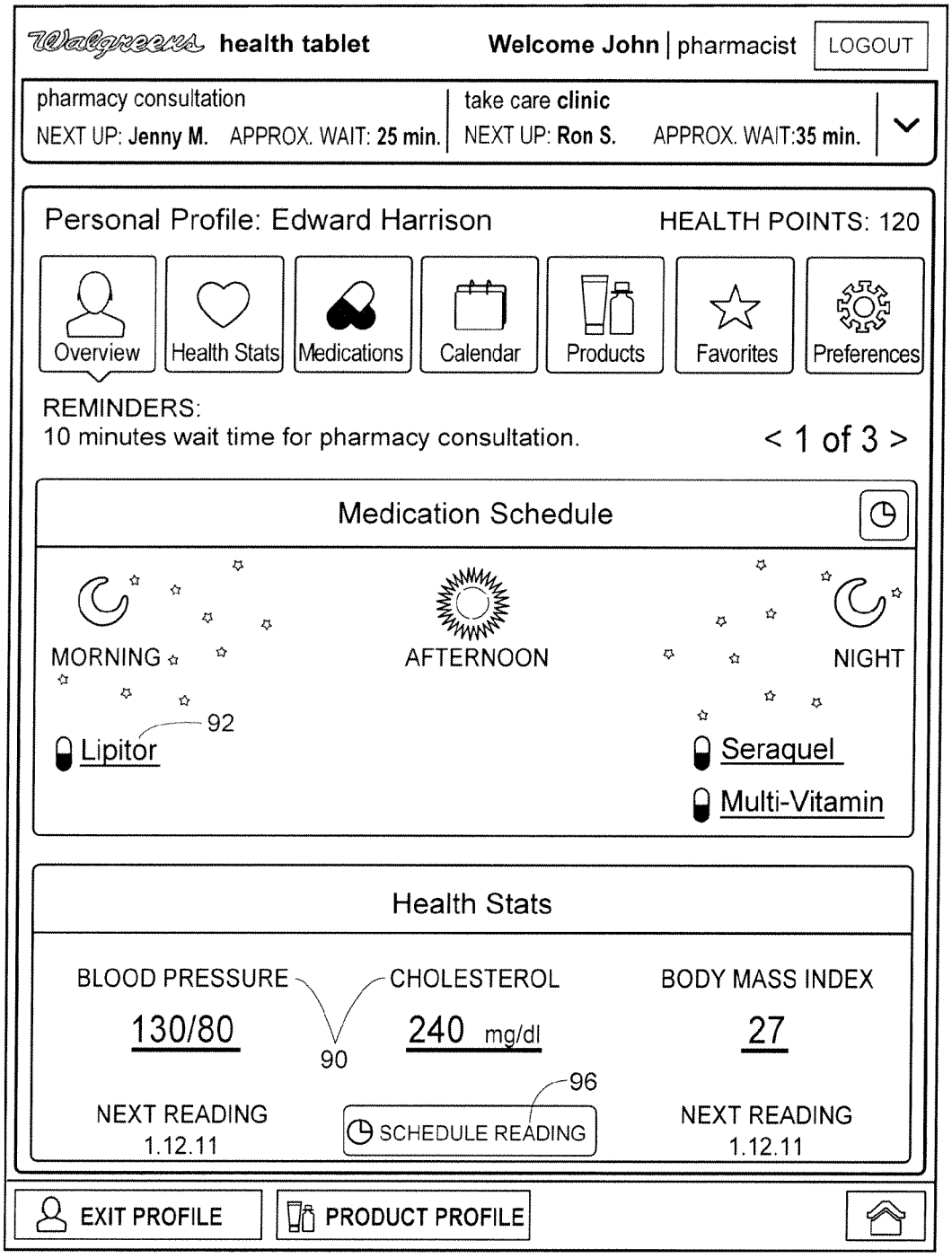
FIG. 11 is an example of a personal profile that can be displayed on the touchscreen device.

If a customer has a specific health care question, then the health guide can use a touchscreen device to bring up the customer's profile, look up drug interactions, and research products that the customer might wish to consider. A customer can be identified in the organization's computer records in any of the many well-known ways, such as by swiping an identification card or entering the customer's name or telephone number. As seen in FIG. 11, for example, a personal profile for a particular customer can include health information 90 such as statistics on the customer's last recorded blood pressure, cholesterol, and body mass index, as well as current prescription information 92. The history may also contain a history of the customer's medications and product purchases. The customer's account status in the "perks" program may also be recorded and displayed on the touchscreen devices.

Once the customer is identified, the system is programmed to use the data associated with the customer to tailor products and services from the store for that customer. For example, the touchscreen devices can be used to show potential OTC interaction challenges presented by the customer's prescription, or to advise the customer of news or upcoming events that may be of particular interest to the customer.

The system is also programmed to check if the customer's data suggest that the pharmacist may have health recommendations that particularly relate to that customer. Pharmacist recommendations might include, for example, possible recommendation about drug interactions involving medicine that the customer uses. When the data suggest that the pharmacist may have such a recommendation, the system is programmed to cause the touchscreen devices to prompt the health guide to steer the customer to the pharmacist station 52.

The system is also programmed to check if the customer's data suggest that the medical assistant may have health recommendations for the customer. These recommendations might include, for example, a possible recommendation about immunizations or screenings. When such possibilities are found, the system is programmed to cause the touchscreen devices to steer the customer to the clinic station 40. For example, the screen seen in FIG. 11 includes a prompt 96 for scheduling a new screening.

Similarly, the store's computer system is also programmed to check the customer data and, when warranted, cause the touchscreen devices to prompt a customer to sign-up for a pertinent upcoming community health care event in the flexible workspace 42.

It is preferred that information on portable touchscreen devices be written with limited jargon, in language that can be easily understood by customer. That way, a store employee using a health tablet will feel comfortable showing and discussing the display with the customer, building common trust.

The Secure Preparation Area and the Prescription Station

The restricted-access, secure preparation area 50 (best seen in FIGS. 1, 6 and 7) is used for storing the materials used for filling a customer's prescription. As is customary, it includes rows of storage 100 and a work counter 102 where the prescription can be packaged for delivery to the customer.

The prescription station 48 preferably includes two separate prescription desks where a filled prescription can be turned over to a customer. One prescription desk is a traditional desk 106 where a customer has a traditional person-to-person interaction with a pharmacy technician who takes or fills the customer's prescription. The other prescription desk 78 is a "rapid refill" desk with prescription kiosks 108 that a customer can use to identify himself or herself, review his or her prescription and insurance information on-screen, and pay for his or her prescription. To provide good flow, the illustrated prescription desks are adjacent and angled with respect to each other and face the reception desk 46, giving direct line-of-sight to the display 82 above the reception desk where wait times are displayed.

In the illustrated arrangements, the traditional desk 106 is one section of a continuous pharmacy countertop 112. The traditional desk is accessible to customers at a prescription area 114 in front of that section of the countertop. The customer-accessible side of this section of the countertop is preferably between six and twelve feet long. In the example seen in FIG. 6, this section is nine feet, eleven inches long on the customer side and eleven and-a-half feet long on the opposite, secure side. In the example seen in FIG. 7, this section of the pharmacy countertop is nine feet, ten inches long on the customer side and ten feet, eleven inches long on the secure side. In both illustrations, the traditional desk measures 2 feet, eight inches from the customer edge to the secure edge, though this dimension and the other stated dimensions could vary.

In both the arrangement seen in FIG. 6 and the arrangement seen in FIG. 7, the traditional desk 106 is positioned between the rapid refill desk 78 and the pharmacist station 52. The two prescription kiosks 108 are positioned at opposite ends of the rapid refill desk and are separated by an open space 118 through which a technician in the restricted-access secure preparation area 50 can interact with a customer.

Figure 12:
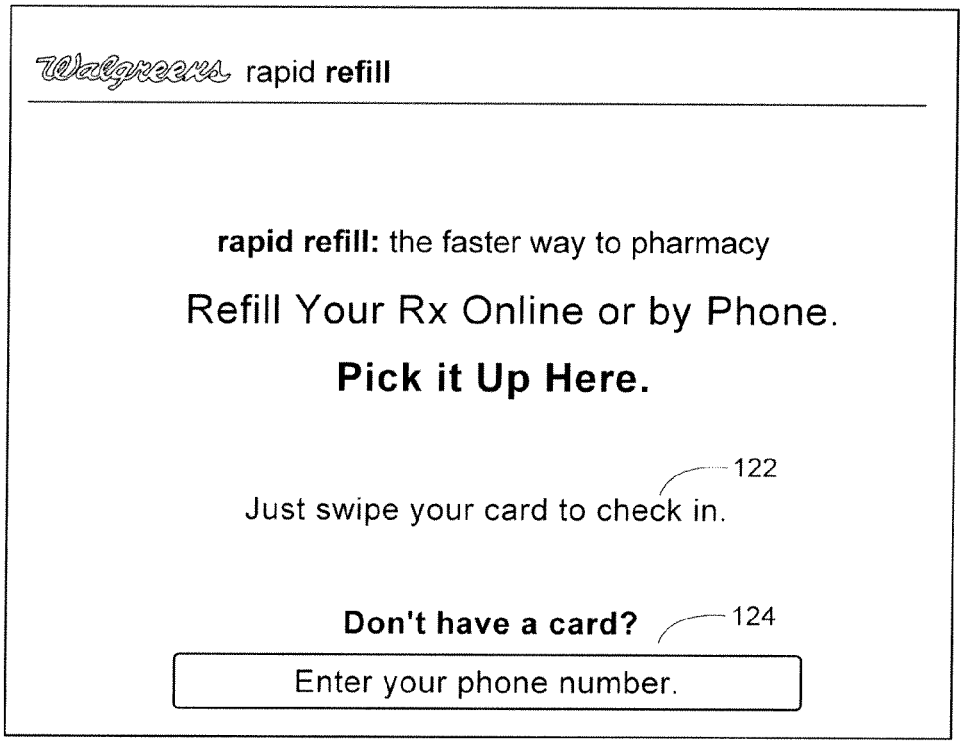
FIG. 12 is a home page screen display on another touchscreen device that can be used in the workspace.

A customer using one of the prescription kiosks 108 can identify himself or herself in a variety of ways. For example, a customer could identify himself or herself by swiping an identity card, or by entering his or her name or telephone number. FIG. 12 shows one example of an opening screen that could be displayed on the prescription kiosk. It includes a prompt 122 for a customer to swipe an identification card, and a separate instruction 124 that the customer can also identify himself or herself by entering his or her telephone number. As technology continues to advance, identification could be done with little or no deliberate action by the individual. Identification could be made, for example, by detecting the individual's cell phone signal, or by visual image recognition. Once the individual is identified, the system is programmed to pull up the associated prescription information, and a signal can be sent to a pharmacist technician in the secure preparation area 50, who can then begin work on processing the customer's prescription.

Figure 13:
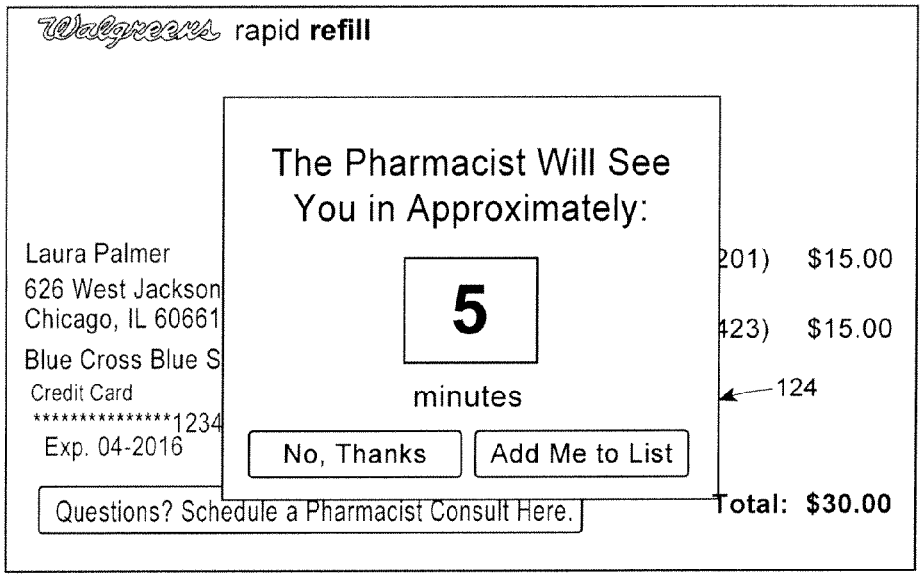
FIG. 13 is an example of another screen display that can be presented on the display seen in FIG. 12.

A customer's check-out process can be completed in as few as three or four clicks on the screen of the prescription kiosk 108. After the customer has been identified, the prescription kiosk is programmed to display to the customer a second screen that confirms the customer's personal information, prescription information, and insurance information, estimates how long it will take for the order to be filled, states the price for filling the order, and asks the customer if he or she wants to proceed. Preferably, the screen also provides the customer with an option 124 for scheduling a consultation with the pharmacist at the pharmacist station 52. An example of such a screen is seen in FIG. 13. If the customer wants to proceed, the next screen can provide payment options. A final screen tells the customer where and when the order can be picked up.

Preferably, the prescription kiosk 108 signals to the technician in the secure preparation area 50 when the customer has paid for the order. Once the payment is made, the technician may reconfirm the customer's identity and then deliver the filled prescription to the customer, completing the process. It is believed that this semi-automated process minimizes labor expenses and provides added convenience to customers. The added convenience may lead to increased prescription loyalty, further increasing profitability.

Coupling this expedited prescription process with improved customer access to a pharmacist (at the pharmacist station 52, as described below) is believed to be particularly valuable.

The Pharmacist Station

In the new pharmacy workspace 10, one of the new, alternative ways that a customer can obtain health care information is through one-on-one communications with a pharmacist at the new pharmacist station 52. The pharmacist station is preferably staffed by a pharmacist who is hired for his or her ability and desire to work directly with customers.

In the examples illustrated in FIGS. 6 and 7, the pharmacist station 52 is adjacent the prescription station 48. Adjacent to the traditional desk 106 of the pharmacy countertop 112 is another section 130 of the pharmacy countertop that is accessible, through a pass-through window 132 (see FIG. 1), to pharmacist seating 134 behind the pharmacist desk 76. In the illustrated examples, this section of the pharmacy countertop is approximately 2 feet wide and approximately 1 foot, eleven inches deep. The pass-through window is positioned less than three feet from the pharmacist seating, and provides the pharmacist with direct line-of-sight to the work counter 102 in the secure preparation area 50. This line-of-sight enables the pharmacist to interact directly with the secure preparation area 50 and oversee technicians working in that area, without losing access to customers.

In the illustrated pharmacist station 52, a pharmacist sitting in the pharmacist seating 134 can directly interact with a customer in front of the pharmacist desk 76. The pharmacist desk seen in FIGS. 6 and 7 has a front counter 140 that is five feet five inches wide and two feet deep, and is accessible to customers at a customer position 142 in front of the desk. The pharmacist desk is spaced three feet, five inches in front of a back wall 144, with the front edge of the desk spaced 4 feet, eight inches in front of the front edge of the pharmacy countertop 112. These dimensions could vary. A two-foot deep lateral counter 148 on the pharmacist desk extends rearwards from one end of the front edge of the desk back to the pharmacy countertop. Thus, the pharmacist seating is in the interior of a "u" shape formed by the pharmacist desk and the back wall. The seating is accessed from a four-to-five foot wide hallway 152 that leads back from the open circulation area 54. Farther back down the hallway is a lockable door 154 that the pharmacist can use to enter the secure preparation area 50. In the illustrated arrangements, this door is only a few feet from the pharmacist seating.

Figure 9:
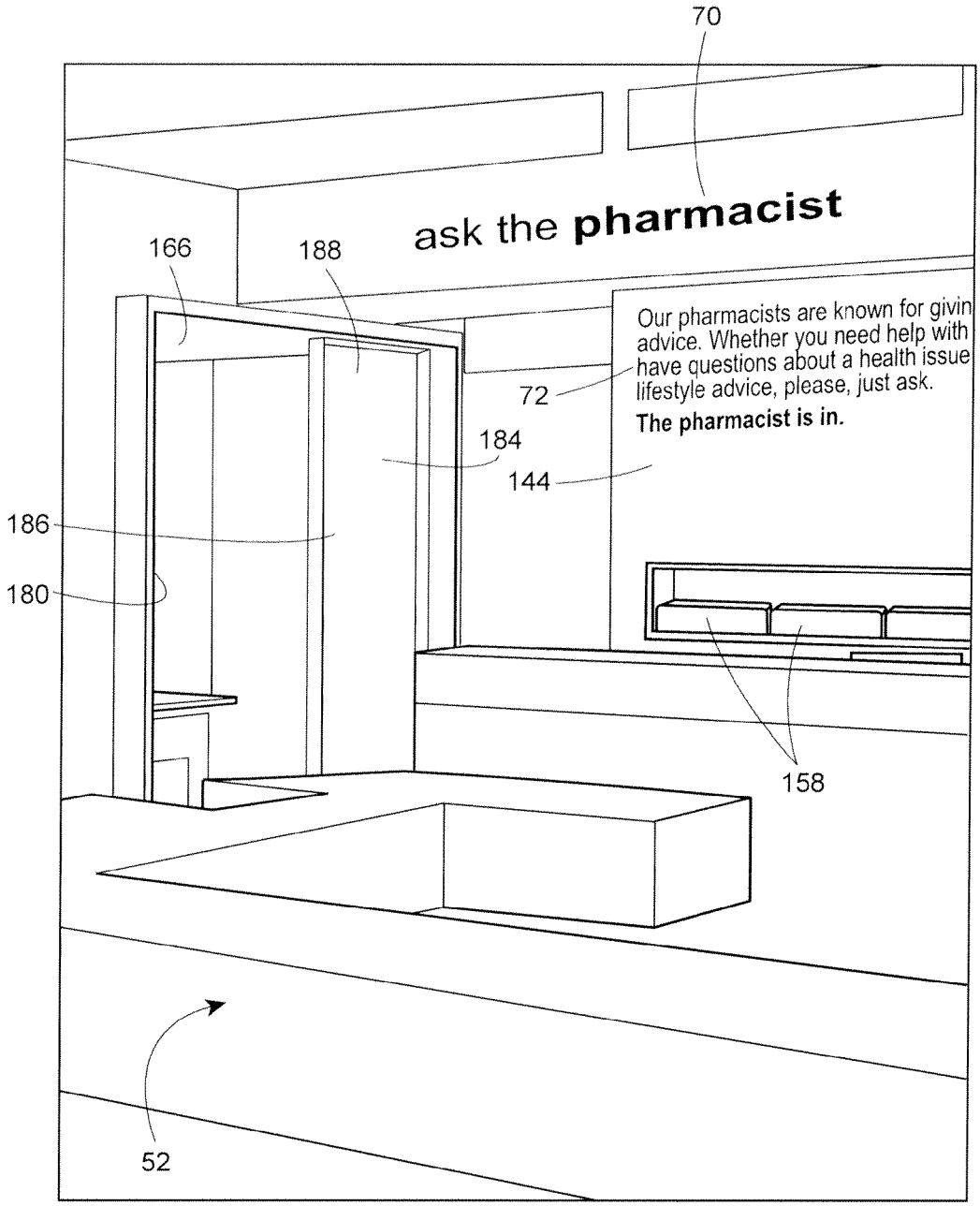

As seen in FIG. 9, the back wall 144 can be used for displaying the conversational statement 72 about the store's pharmacists and can include bins 158 for storing materials such as handouts that the pharmacist may hand out to customers.

Figure 14:
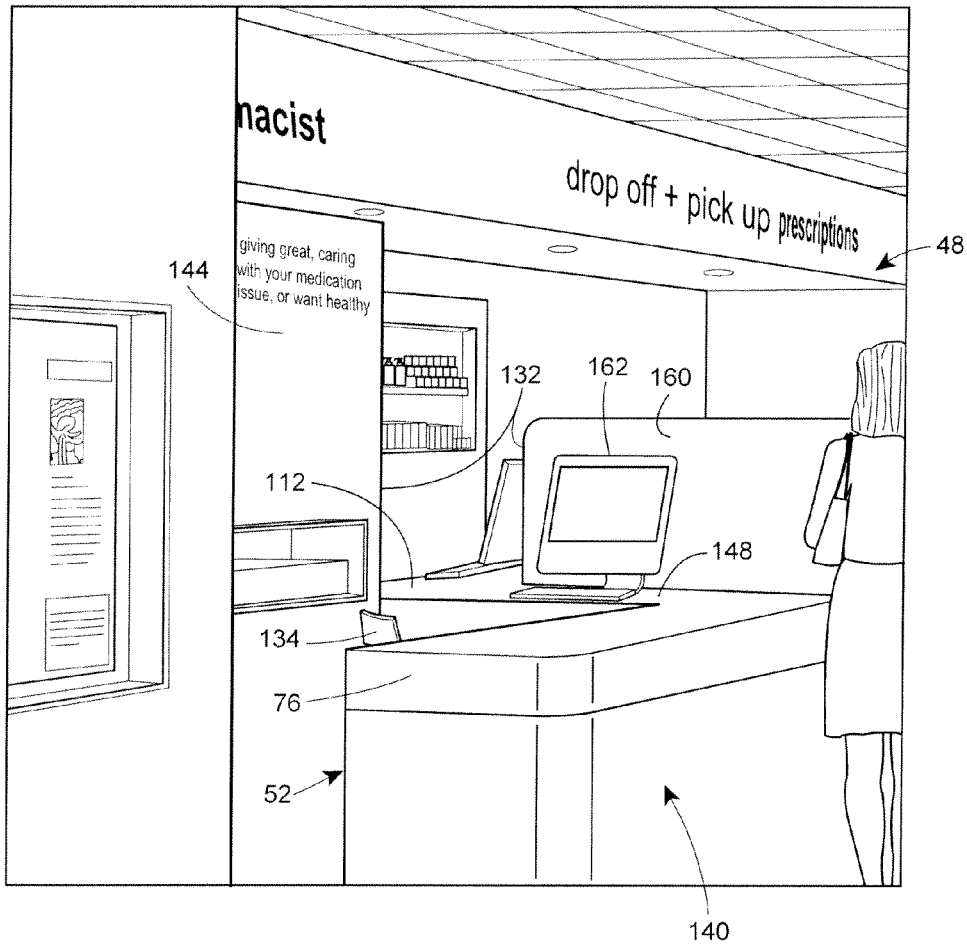
FIG. 14 is another customer-level perspective view of a part of the new workspace.

As best seen in FIG. 14, a divider 160 can be positioned on the lateral counter 148. Such a divider may help customers to recognize a distinction between the pharmacist station 52 and the prescription station 48. The illustrated divider is made of transparent or translucent plastic or glass, and has a top edge that is no more than four to five feet above the floor. This limited height helps to promote visibility between the spaces, while still allowing customers to recognize that different spaces are being provided. Preferably, the divider is arranged perpendicular to the pharmacy countertop 112, and extends from near the front edge of the pharmacist desk 76 to the front edge of the pharmacy countertop.

Arranging the pharmacist seating 134 in this way, with the back wall 144 positioned rearward of the front edge of the pharmacy countertop 112 in the prescription station 48, helps to improve the pharmacist's visibility into the secure preparation area 50. On the other hand, keeping the pharmacist seating forward (in this case, forward of the back edge of the pharmacy countertop), helps to highlight to customers that the pharmacist is available for consultation.

For security, the illustrated pass-through window 132 is at least four feet from the front of the pharmacist desk 76, and the pharmacist seating 134 is positioned between the front counter 140 of the desk and the pass-through window, making the pass-through window inaccessible to customers in front of the desk.

To enhance the base of knowledge upon which the pharmacist can rely, the illustrated pharmacist station 52 is provided with a touchscreen device 162 similar to those at the reception desk 46. Preferably, a pharmacist who accesses the touchscreen device has access to all the other information available to the health guide. With the pharmacist thus equipped and positioned, customer interactions are expected to lead to deeper customer relationships. This may increase customer loyalty, in particular from chronic patients. Additionally, a relationship-driven approach is expected to increase service sales, front-end trips, and overall lifetime customer value.

To further enhance customer-pharmacist interactions, a private consulting area 166 is provided in the pharmacist station 52. As seen in FIG. 9, this room provides a private setting where customers may feel more comfortable in taking discussions beyond medication instruction into life-style challenges and goal setting. The room can also be used as a facility where the pharmacist or a nurse practitioner can provide screenings and immunizations. In the arrangements seen in FIGS. 6 and 7, this private consulting area measures between 120 and 200 square feet in area, and has a table 168, guest seating 170, and storage 172.

Figure 5:
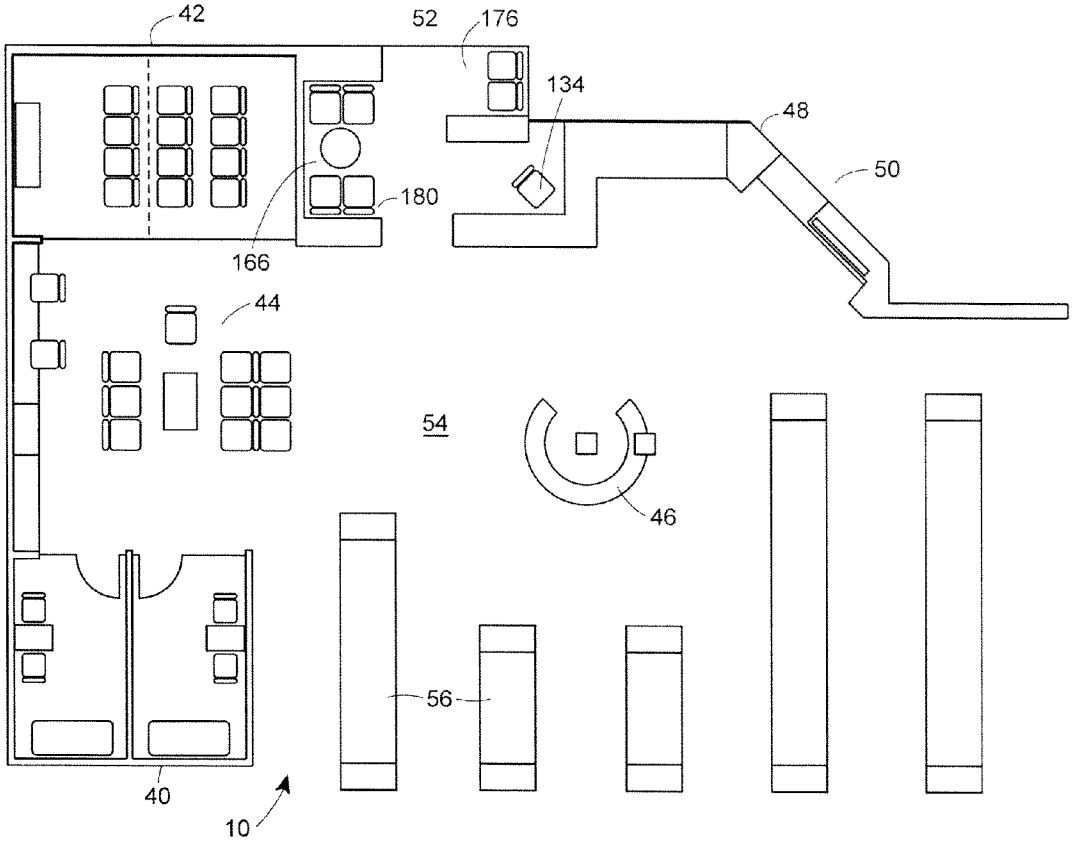

In the example seen in FIG. 5, a separate screening/immunization room 176 is provided behind the pharmacist seating 134. In that room, a pharmacist or nurse practitioner can provide a variety of screenings or immunizations.

To make customers aware of its availability, the private consulting area 166 has an entrance 180 that is located directly to a side of the pharmacist seating 134. Positioned across the hallway 152 from the opening to the pharmacist seating, the entrance to the private consulting area is perpendicular to the width of the front counter 140 of the pharmacist desk 76. Preferably, the angle between the customer position 142 in front of the pharmacist desk, the pharmacist seating, and the entrance to the private consulting area is between 45 and 100 degrees, and the entrance is less than five feet from the pharmacist seating and less than ten feet from the customer position in front of the pharmacist desk.

Although easy accessibility to the private consulting area 166 is valuable, it is also useful to arrange the room so the customers feel that the space offers privacy. While a traditional door suggests privacy, a door could also lead to a customer feeling trapped. To address this issue, the entrance 180 to the new private consulting area can be specially arranged.

Figure 4:
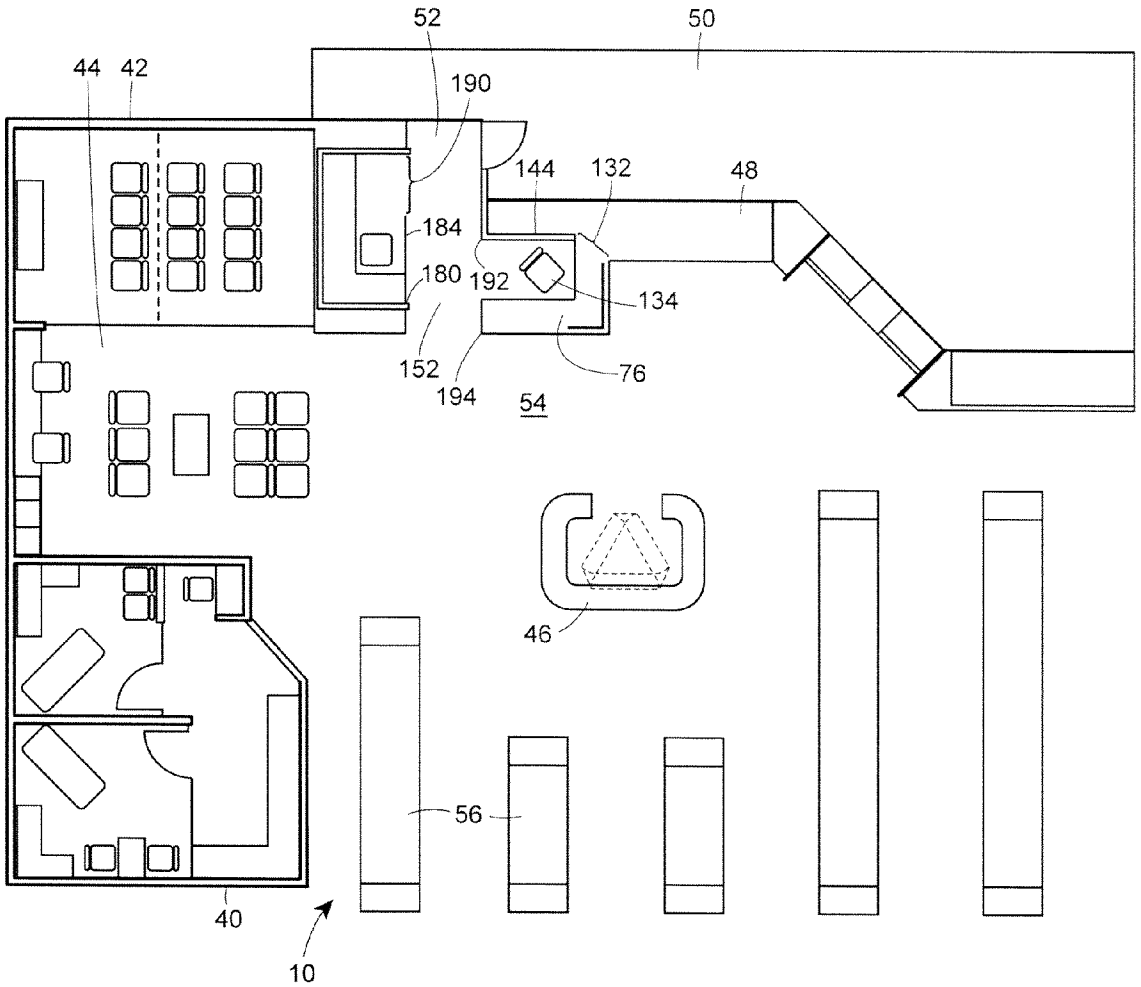
FIGS. 4 and 5 are floor plans of other embodiments of the new pharmacy workspace.

The entrance 180 illustrated in FIGS. 6 and 7 is between six and eight feet wide, and, as seen in FIGS. 1, 4, and 9, is fitted with a sliding screen 184 that is between two and three-and-a-half feet wide. The illustrated sliding screen is made of glass or plastic and has one section 186 of relatively low transparency and one or more edges 188 of greater transparency. The lower edge of the illustrated screen can extend all the way to the floor or could stop one and three feet above the floor. Clear or translucent glass or plastic can provide transparency, while coating or frosting can reduce the transparency in the low-transparency section.

The illustrated screen 184 is a rigid screen that hangs from a track and slides laterally between a welcoming position seen in FIGS. 1 and 9 and a privacy position seen in FIG. 4. In the welcoming position, the guest seating 170 in the private consulting area 166 is visible from the customer position 142 in front of the pharmacist desktop 136. In the privacy position, on the other hand, the relatively low transparency section 186 is interposed between the guest seating and the customer position in front of the desktop, screening the guest seating from view from the customer position. However, as seen in FIG. 4, the use of a rigid screen results in a more than 2-foot wide section 190 of the entrance 180 still being left open when the screen is in the privacy position. This opening helps to reduce the chance of a customer feeling trapped in the space, while still screening the guest seating from view of any customers in the open circulation area 54. Thus, this openness may help the customer to feel comfortable in the space, while still enjoying a sense of privacy.

In the illustrated examples, the pass-through window 132 adjoins the back wall 144 and is spaced at least three feet from the end 192 of the back wall that adjoins the hallway 152, across from the terminal end 194 of the pharmacist desk 76. The entrance 180 to the private consulting area 166 is more than six feet from the pass-through window, and the pharmacist seating 134 is positioned between the private consulting area and the pass-through window. This positioning helps to ensure the security of the secure preparation area 50.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A retail store comprising:

a first counter and door that securely separate a secure pharmacy preparation area from a customer area;

a pharmacist workstation that is located entirely in the customer area and has:

signage that indicates that a pharmacist is available for consultation with customers;

a desk that is accessible to customers at a customer position in front of the desk;

a pharmacist seating area that is located directly behind the desk and entered from another part of the customer area, from which direct interactions can be made with a customer in front of the desk; and a consulting area that has an entrance that is located to a side of the pharmacist seating area, and has a screening element that selectively screens a patient position within the consulting area from view from the customer position in front of the desk; and a pass-through window that provides a direct line-of sight from the pharmacist seating area to a separate preparation counter in the secure pharmacy preparation area, and is directly adjacent the pharmacist seating area.

2. The retail store as recited in claim 1, in which the first counter has a continuous countertop that:

has one section that is accessible to customers at a prescription area in front of that section of the countertop; and has an adjacent section that is in the secure pharmacy preparation area and is directly accessible, through the pass-through window, from the pharmacist seating area.

3. The retail store as recited in claim 1, in which:

the pharmacist seating area is positioned between the desk and the pass-through window, making the pass-through window inaccessible to customers in front of the desk.

4. The retail store as recited in claim 1, in which:

the pass-through window is positioned at least four feet from the front of the desk.

5. The retail store as recited in claim 1, in which:

the pharmacist seating area is positioned between the consulting area and the pass-through window.

6. The retail store as recited in claim 1, in which:

the desk has a terminal end;

the pharmacist seating area is between the desk, a back wall, and a lateral counter that extends rearward from a front counter of the desk toward the back wall;

the pass-through window is on the back wall and is spaced at least three feet from a point on the back wall across from the terminal end of the desk.

7. The retail store as recited in claim 1, in which:

the entrance to the consulting area is less than ten feet from both the pharmacist seating area and from the customer position in front of the desk, and more than six feet from the pass-through window.

8. The retail store as recited in claim 1, in which:

the entrance to the consulting area is perpendicular to a width of the desk, and an angle between the customer position, the pharmacist seating area, and the entrance to the consulting area is between 45 and 135 degrees.

9. The retail store as recited in claim 1, in which:

the screening element has a sliding screen that slides laterally between (a) a welcoming position in which guest seating in the consulting area is visible from the customer position in front of the desk and (b) a privacy position in which the guest seating is screened from view from the customer position.

10. The retail store as recited in claim 1, in which:

the entrance to the consulting area is between six and eight feet wide, and the screening element fits in the entrance and takes the form of a sliding screen that is between two and three-and-a-half feet wide.

11. The retail store as recited in claim 1, in which:

the screening element fits in the entrance to the consulting area and takes the form of a sliding screen that slides to a privacy position that (a) is interposed between guest seating in the consulting area and the customer position in front of the desk, and (b) leaves open a more than 2-foot wide section of the entrance.

12. The retail store as recited in claim 1, in which:

the screening element fits in the entrance to the consulting area and takes the form of a sliding screen that has a section of relatively low transparency and one or more edges of greater transparency.

13. The retail store as recited in claim 1, in which the screening element fits in the entrance to the consulting area and takes the form of a sliding screen that:

has a section of relatively low transparency and one or more edges of greater transparency; and has a closed position in which (a) the section of relatively low transparency is interposed between guest seating in the consulting area and the customer position in front of the desk, and (b) a more than 2-foot wide section of the entrance is left open.

14. A retail store comprising:

a first counter and single door that securely separate a secure pharmacy preparation area from a customer area;

a pharmacist workstation that is located in the customer area and has:

signage that indicates that a pharmacist is available for consultation with customers;

a desk that is accessible to customers at a customer position in front of the desk;

a pharmacist seating area that is located behind the desk and entered from another part of the customer area, from which direct interactions can be made with a customer in front of the desk; and a consulting area that has an entrance that is located less than ten feet from the pharmacist seating area, and has a screening element that selectively screens a part of the consulting area from view from the customer position in front of the desk; and a pass-through window that provides a direct line-of sight from the pharmacist seating area to a separate preparation counter in the secure pharmacy preparation area.

15. A retail store comprising:

a first counter and single door that securely separate a secure pharmacy preparation area from a customer area;

a pharmacist workstation that is located in the customer area and has:

a desk that is accessible to customers at a customer position in front of the desk;

a pharmacist seating area that is entered from another part of the customer area and is located between the desk, a back wall, and a lateral counter that extends rearward from a front counter of the desk toward the back wall, from which direct interactions can be made with a customer in front of the desk; and a consulting area that has an entrance located proximate to the pharmacist seating area, the consulting area further including a sliding screen that has a section of relatively low transparency, one or more edges of greater transparency, and a closed position in which (a) the section of relatively low transparency is interposed between a part of the consulting area and the customer position in front of the desk, selectively screening that part of the consulting area from view from the customer position; and (b) a more than 2-foot wide section of the entrance is left open; and a pass-through window that is on the back wall, is positioned less than three feet from the pharmacist seating area and at least four feet from the front of the desk, is spaced at least three feet from a point on the back wall across from a terminal end of the desk, and provides a direct line-of sight from the pharmacist seating area to a separate preparation counter in the secure pharmacy preparation area.

* * * * *